US007639974B2

(12) United States Patent
Kimura et al.

(10) Patent No.: US 7,639,974 B2
(45) Date of Patent: Dec. 29, 2009

(54) COLOR IMAGE FORMING APPARATUS WITH PRE-SECONDARY TRANSFER CHARGE ELIMINATING SECTION

(75) Inventors: Takenobu Kimura, Hachioji (JP); Yotaro Sato, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 480 days.

(21) Appl. No.: 11/602,563

(22) Filed: Nov. 21, 2006

(65) Prior Publication Data

US 2007/0196140 A1 Aug. 23, 2007

(30) Foreign Application Priority Data

Feb. 22, 2006 (JP) ..... 2006-045063

(51) Int. Cl.
*G03G 15/16* (2006.01)

(52) U.S. Cl. ..... 399/296

(58) Field of Classification Search ..... 399/127, 399/128, 296, 298, 299, 302
See application file for complete search history.

(56) References Cited

U.S. PATENT DOCUMENTS

| | | | | |
|---|---|---|---|---|
| 5,999,783 | A * | 12/1999 | Folkins | 399/296 |
| 7,298,997 | B2 * | 11/2007 | Hamada et al. | 399/296 |
| 7,346,302 | B2 * | 3/2008 | Sato et al. | 399/296 |
| 7,440,719 | B2 * | 10/2008 | Kimura et al. | 399/296 |

FOREIGN PATENT DOCUMENTS

| | | |
|---|---|---|
| JP | 10-274892 | 10/1998 |
| JP | 11-143255 | 5/1999 |

* cited by examiner

*Primary Examiner*—William J Royer
(74) *Attorney, Agent, or Firm*—Cantor Colburn LLP

(57) ABSTRACT

A color image forming apparatus for forming a color image onto a transfer material by superimposing a plurality of unicolor toner images. The apparatus makes it possible to produce a high quality image through a secondary transferring operation with a good secondary transferring efficiency. At a pre-secondary transfer charge eliminating section, an electric potential difference between a grid electrode disposed at an upstream side and an opposing electrode is set at such a value that is greater than that between a grid electrode disposed at a downstream side and an opposing electrode.

10 Claims, 12 Drawing Sheets

COLOR IMAGE FORMING APPARATUS WITH PRE-SECONDARY TRANSFER CHARGE ELIMINATING SECTION

This application is based on Japanese Patent Application NO. 2006-045063 filed on Feb. 22, 2006 in the Japanese Patent Office, the entire content of which is hereby incorporated by reference.

BACKGROUND OF THE INVENTION

The present invention relates to a copier, a printer, a facsimile and an image forming apparatus employing an electrophotographic method and having the functions mentioned above, and specifically relates to a color image forming apparatus that is provided with an intermediate transfer member on which a plurality of unicolor images are overlapped on each other so as to form a full color toner image.

Well known has been a color image forming apparatus that employs the electrophotographic method in which a toner image formed on an image bearing member serving as a photoreceptor element is transferred onto the intermediate transfer member (a primary transferring operation), and then, the toner image transferred onto the intermediate transfer member is further transferred onto a transfer material (a secondary transferring operation). In such a color image forming apparatus, unicolor toner images sequentially formed on a plurality of image bearing members and charged in a predetermined polarity are transferred onto the intermediate transfer member by employing electrostatic actions in such a manner that the unicolor toner images are superimposed on each other, and then, a full color toner image formed on the intermediate transfer member is further transferred onto the transfer material by employing an electrostatic action.

Since it is possible for the color image forming apparatus employing the intermediate transfer member to superimpose the unicolor toner images formed on a single or a plurality of image bearing member(s) on the intermediate transfer member, such a color image forming apparatus has been widely applied as a color image forming apparatus to form full color images on the transfer material. In this type of color image forming apparatus, the unicolor toner images formed on a single or a plurality of image bearing member(s) are transferred onto the intermediate transfer member in such a manner that the unicolor toner images overlap each other, and then, the overlapping toner image formed on the intermediate transfer member is further transferred onto the transfer material by employing the electrostatic action.

Since an electrostatic charge amount per one toner particle is substantially uniform among plural toner particles, an electric potential of the toner layer residing on the intermediate transfer member varies depending on an amount of toner attached within a predetermined area. Accordingly, in this color image forming apparatus, within the overall toner image formed on the intermediate transfer member, an electrostatic charge potential of a partial area on which plural unicolor toner images overlap each other is greater than that of other partial areas on which only a single unicolor toner image exists. Further, for instance, when the overall toner image formed on the intermediate transfer member includes both a solid color area and a halftone color area, an electrostatic charge potential of the solid color area is greater than that of the halftone color area.

Further, variation of the electrostatic charge potential within the overall toner image after passing through a primary transferring section, at which the unicolor toner image is transferred from the image bearing member to the intermediate transfer member, sometimes would occur due to environmental factors.

When the electric potential of the toner image residing on the intermediate transfer member widely varies as mentioned above, various areas whose transferring characteristics are different from each other, coexist in the same toner image. Therefore, attempting to transfer such image areas, whose transferring characteristics differ from each other, onto the transfer material under the same transferring condition, various kinds of image defects are liable to occur at the time of the secondary transferring operation from the intermediate transfer member to the transfer material.

In recent years, the color imaging trend has proliferated in the field of copiers, printers, facsimiles and compound image forming apparatus combining the functions of the above-mentioned apparatuses, and, as for the transferring process, the demands for producing high-quality images have been getting larger than ever, due to the progressing trend of employing a polymer toner and a micro particle toner. In addition, the trend of increased production of the image forming apparatuses has also progressed. To obtain excellent images while meeting such trends, it is necessary to compensate for the electric potential of the toner layer residing on the intermediate transfer member, which is liable to vary depending on a number of primary transferring operations and the environmental factors, so as to make it uniform over the toner layer and to improve the secondary transferring efficiency.

Patent Document 1 (Tokkaihei 10-274892, Japanese Non-Examined Patent Publication) sets forth an apparatus that is provided with a pre-secondary transfer charging section for making an electrostatic charge potential of a toner layer residing on an intermediate transfer member uniform by applying a bias voltage, having a polarity same as that of a toner, onto a toner image, before transferring the toner image onto a transfer material.

Patent Document 2 (Tokkaihei 11-143255, Japanese Non-Examined Patent Publication) sets forth an apparatus in which a toner layer residing on an intermediate transfer member is made uniform by applying a bias voltage, having a polarity the same as that of a toner, onto a toner image, and at the same time, a potential difference controlling section controls a direct current electric power source (hereinafter, referred to as a DC power source, for simplicity) of a pre-secondary transfer charging section as well as another DC power source of a secondary transferring section, so that a potential difference between an electric potential of the toner layer, which is made uniform by the pre-secondary transfer charging section, and another electric potential of the secondary transferring section is kept substantially constant.

The color image forming apparatus set forth in Patent Documents 1 and 2 (Tokkaihei 10-274892 and Tokkaihei 11-143255, both being Japanese Non-Examined Patent Publication) compensates for an electrostatic charge amount of toner upstream side of the secondary transferring section by employing a scorotron charger. In other words, this is a technology for evening an electrostatic charge amount of toner, primarily transferred onto the intermediate transfer member, by employing a corona discharging phenomenon, such as an AC discharging action, a DC discharging action, etc.

On the other hand, in order to prevent density unevenness caused by a transferring charge shortage occurring at the time when a potential of the toner layer is high due to an excessive amount of attached toner, and to prevent occurrence of discharging action when increasing a transferring charge amount, it could be considered that the pre-secondary transfer charge eliminating section, having a scorotron electrode, is disposed upstream from the secondary transferring section so as to conduct a discharging operation of the toner image on the intermediate transfer member.

A scorotron charging device is employed in the pre-secondary transfer charging section. However, even when the scorotron charging device is employed, a potential decrease at a low potential portion would occur to some extent. Accordingly, when simply employing a strong discharging operation, although a sufficient discharging effect for portions carrying a large amount of toner can be achieved, an electric potential at the portions carrying a small amount of toner are also lowered. On the contrary, when a discharging operation is weak, it is impossible to decrease a potential value of portions carrying a large amount of toner to a desired value, resulting in a difficulty of satisfying both of the above-mentioned factors at the same time.

With respect to a conventional case in which a discharging operation before secondary transfer is conducted once by employing a single discharging device, the present inventors measured the potentials of the toner layer after applying a discharging operation versus the potentials of the toner layer before applying a discharging operation, by setting a grid voltage of a single discharging device, disposed at a pre-secondary transfer charge eliminating section, at three levels of −150V, −100V and −50V. As a result, the present inventors confirms that it is impossible for the single discharging device to achieve the adjustment of a toner layer potential, which satisfies both of the appropriate discharging operations for the portions carrying a large amount of toner, such as an overlapped solid color image, etc., and the portions carrying a small amount of toner, such as a halftone color image, etc., resulting in an inability of obtaining a good image.

SUMMARY OF THE INVENTION

To overcome the above-mentioned drawbacks in conventional color image forming apparatus, the present inventors direct their attention to the point that ratios of inclinations of an electric potential drops at a low potential area and a high potential area are different from each other, depending on a difference between settings of grid potentials, in a discharging operation conducted by a scorotron discharger. As a result of intensive considerations based on the above-mentioned point, the present inventors have found that the electric potential drop at the portions carrying small amounts of toner could be suppressed within a narrow range by initially conducting the discharging operation with a high grid electric potential, and then, secondary conducting the discharging operation with a low grid electric potential, compared to the case in which both discharging operations are conducted under the same condition.

Namely, it is an object of the present invention to provide a color image forming apparatus, which makes it possible to produce a high quality image through a secondary transferring operation with a good secondary transferring efficiency.

Accordingly, to overcome the cited shortcomings, the above-mentioned object of the present invention can be attained by a color image forming apparatus described as follow.

A color image forming apparatus for forming a color image onto a transfer material by superimposing a plurality of unicolor toner images, comprising: a plurality of image bearing members to form the plurality of unicolor toner images on the plurality of image bearing members, respectively; a plurality of primary transferring sections that correspond to the plurality of image bearing members to transfer the plurality of unicolor toner images formed on the plurality of image bearing members, respectively; an intermediate transfer member onto which the plurality of unicolor toner images are successively transferred one by one in such a manner that the plurality of unicolor toner images overlap with each other, so as to form a full color toner image on a toner-image bearing surface of the intermediate transfer member; a secondary transferring section to transfer the full color toner image, formed on the toner-image bearing surface of the intermediate transfer member, onto the transfer material; and a pre-secondary transfer charge eliminating section disposed between the plurality of primary transferring sections and the secondary transferring section, including a plurality of discharge devices aligned along the toner-image bearing surface of the intermediate transfer member and an opposing electrode aligned along another surface of the intermediate transfer member opposing to the plurality of discharge devices; wherein each of the plurality of discharge devices includes a discharging electrode and a grid electrode; and wherein an electric potential difference between the grid electrode disposed at an upstream side in a rotating direction of the intermediate transfer member and the opposing electrode, is greater than that between the grid electrode disposed at a downstream side in a rotating direction of the intermediate transfer member and the opposing electrode.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Referring to the embodiment, the present invention will be detailed in the following. The scope of the present invention, however, is not limited to the embodiment described in the following.

<Color Image Forming Apparatus>

Figure 1:
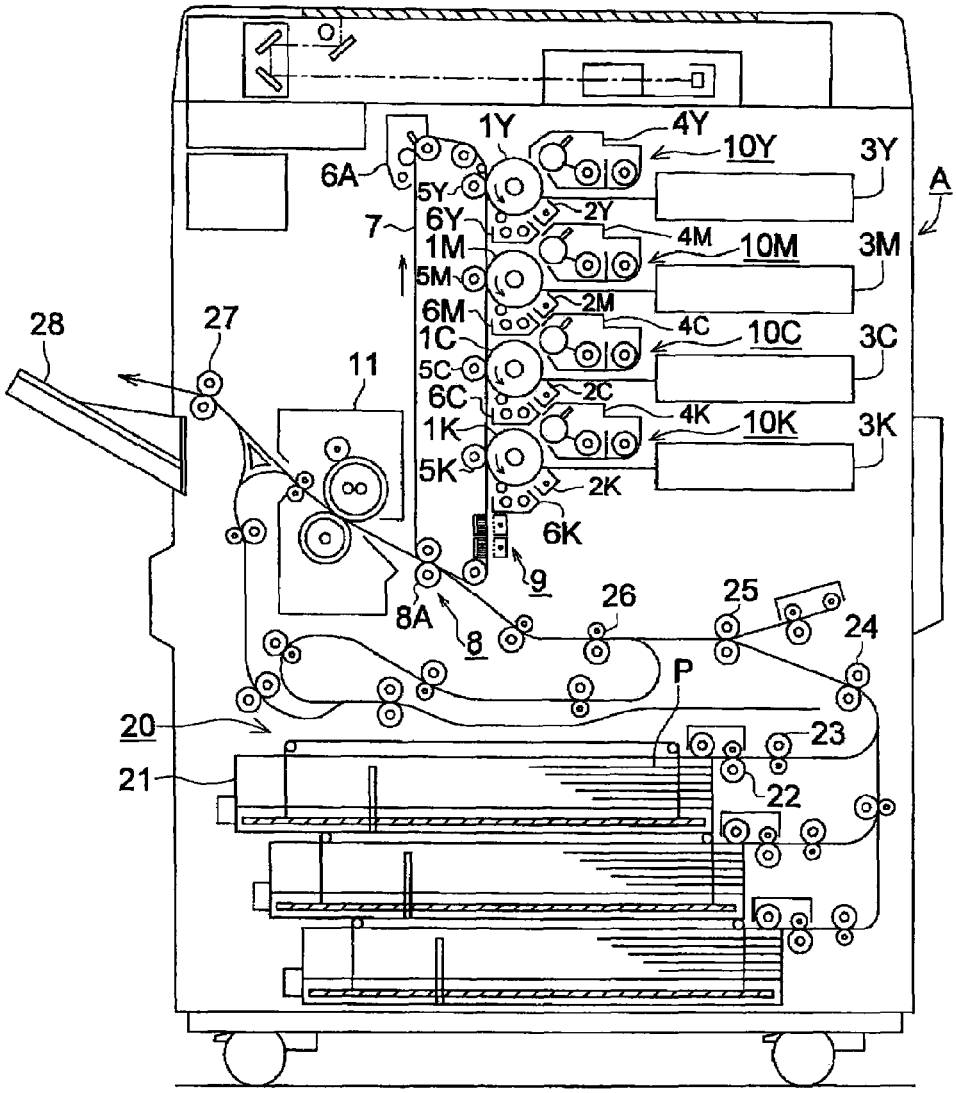
FIG. 1 shows a cross sectional view of an overall configuration of a color image forming apparatus embodied in the present invention.

FIG. 1 shows a cross sectional view of the overall configuration of a color image forming apparatus A embodied in the present invention.

The image forming apparatus A, called a tandem color image forming apparatus, is provided with plural sets of image forming sections 10Y, 10M, 10C, 10K, a belt-type intermediate transfer member 7, primary transferring sections 5Y, 5M, 5C, 5K, an intermediate transfer unit including a secondary transferring section 8, a fixing device 11 and a paper feeding device 20.

The image forming section 10Y for forming a unicolor image of color Y (Yellow) is provided with a charging section 2Y, an exposure section 3Y, a developing section 4Y and a cleaning section 6Y, which are disposed around an image bearing member 1Y.

The image forming section 10M for forming a unicolor image of color M (Magenta) is provided with a charging section 2M, an exposure section 3M, a developing section 4M and a cleaning section 6M, which are disposed around an image bearing member 1M.

The image forming section 10C for forming a unicolor image of color C (Cyan) is provided with a charging section 2C, an exposure section 3C, a developing section 4C and a cleaning section 6C, which are disposed around an image bearing member 1C.

The image forming section 10K for forming a unicolor image of color K (Black) is provided with a charging section 2K, an exposure section 3K, a developing section 4K and a cleaning section 6K, which are disposed around an image bearing member 1K.

Although a well-known material, such as an OPC photosensitive material, an aSi (amorphous Silicon) photosensitive material, etc., can be employed for the image bearing members 1Y, 1M, 1C, 1K, the OPC photosensitive material is preferable. Specifically, the OPC photosensitive material having a negative charging property is preferable, and is employed in the present embodiment.

Figure 2:
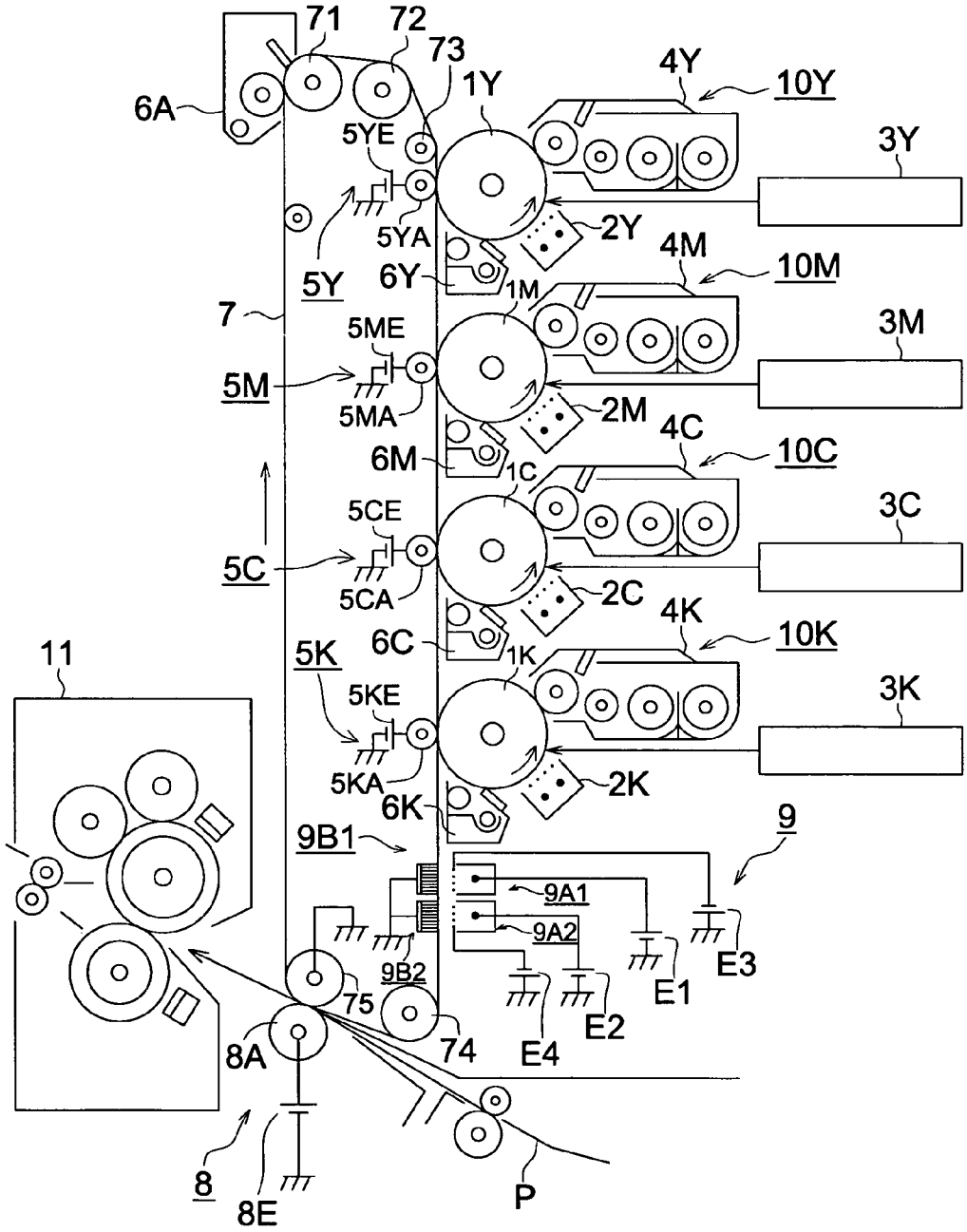
FIG. 2 shows a cross sectional view of a main part of a color image forming apparatus embodied in the present invention.

The belt-type intermediate transfer member 7, as shown in FIG. 2, has a semi-conductive property and is threaded on a plurality of supporting rollers 71, 72, 73, 74 and a backup roller 75 so as to circulatably move along the image bearing members 1Y, 1M, 1C, 1K. In the present embodiment, the belt-type intermediate transfer member 7 is supported in a state of a flat plane at a section between the supporting rollers 73 and 74.

The unicolor images of colors Y, M, C, K respectively formed by the image forming sections 10Y, 10M, 10C, 10K are sequentially transferred one by one onto the belt-type intermediate transfer member 7, by the primary transferring sections 5Y, 5M, 5C, 5K (primary transferring operation), so as to form a full color image while the belt-type intermediate transfer member 7 circularly moves along the image forming sections 10Y, 10M, 10C, 10K.

A transfer material P, accommodated in a paper feeding cassette 21 of the paper feeding device 20, is picked up by a paper feeding roller 22, serving as a first paper feeding section, and is conveyed to the secondary transferring section 8 through paper feeding rollers 23, 24, 25 and a registration roller 26, serving as a second paper feeding section, so as to transfer the full color image onto the transfer material P (secondary transferring operation).

Then, the fixing device 11 applies heat and pressure onto the transfer material P, on which the full color image is already transferred, so as to fix the full color image (or a single color image) onto the transfer material P. Successively, the transfer material P having the fixed color image is ejected by an ejecting roller 27, and is stacked on an ejecting tray 28 disposed outside the apparatus A.

On the other hand, after the full color image is transferred onto the transfer material P by the secondary transferring section 8 and the transfer material P is separated from the belt-type intermediate transfer member 7 by the curvature separating action, a cleaning section 6A removes residual toner remaining on the belt-type intermediate transfer member 7.

<Primary Transferring Section>

FIG. 2 shows a cross sectional view of the main part of the color image forming apparatus A.

The primary transferring section 5Y for transferring the unicolor image of color Y is constituted by a primary transferring roller 5YA and a DC power source 5YE for applying a voltage to the primary transferring roller 5YA. The primary transferring roller 5YA is disposed at such a position that opposes to the image bearing member 1Y while putting the belt-type intermediate transfer member 7 between them, so as to abrasively contact the inner surface of the belt-type intermediate transfer member 7. Further, the DC power source 5YE is coupled to the ground.

The primary transferring section 5M for transferring the unicolor image of color M is constituted by a primary transferring roller 5MA and a DC power source 5ME for applying a voltage to the primary transferring roller 5MA. The primary transferring roller 5MA is disposed at such a position that opposes to the image bearing member 1M while putting the belt-type intermediate transfer member 7 between them, so as to abrasively contact the inner surface of the belt-type intermediate transfer member 7. Further, the DC power source 5ME is coupled to the ground.

The primary transferring section 5C for transferring the unicolor image of color C is constituted by a primary transferring roller 5CA and a DC power source 5CE for applying a voltage to the primary transferring roller 5CA. The primary transferring roller 5CA is disposed at such a position that opposes to the image bearing member 1C while putting the belt-type intermediate transfer member 7 between them, so as to abrasively contact the inner surface of the belt-type intermediate transfer member 7. Further, the DC power source 5CE is coupled to the ground.

The primary transferring section 5K for transferring the unicolor image of color K is constituted by a primary transferring roller 5KA and a DC power source 5KE for applying a voltage to the primary transferring roller 5KA. The primary transferring roller 5KA is disposed at such a position that opposes to the image bearing member 1K while putting the belt-type intermediate transfer member 7 between them, so as to abrasively contact the inner surface of the belt-type intermediate transfer member 7. Further, the DC power source 5KE is coupled to the ground.

Each of the DC power sources 5YE, 5ME, 5CE, 5KE applies a voltage of +1.5 kV and an electric current of 40 μA to each of the primary transferring sections 5Y, 5M, 5C, 5K.

Further, during the time other than the time of the primary transferring operation, the primary transferring sections 5Y, 5M, 5C, 5K are separated from the inner surface of the belt-type intermediate transfer member 7 by a driving section (not shown in the drawings), so as to place them at standby positions.

<Secondary Transferring Section 8>

The secondary transferring section 8 is constituted by the backup roller 75, a secondary transferring roller 8A, and an electric DC power source 8E. The backup roller 75, made of a conductive material, is disposed at a position opposing to the secondary transferring roller 8A while putting the belt-type intermediate transfer member 7 between them, and abrasively contacts the inner surface of the belt-type intermediate transfer member 7.

The backup roller 75 is electrically coupled to the DC power source 8E for applying a voltage onto the backup roller 75. The DC power source 8E of the secondary transferring section 8 applies a voltage of +3 kV and an electric current of 50 μA to the backup roller 75. The residual toner attached to the secondary transferring roller 8A, contacting the belt-type intermediate transfer member 7, is transferred onto the belt-type intermediate transfer member 7 by applying a reverse bias voltage outputted from the electric DC power source 8E, so as to clean the secondary transferring roller 8A.

The backup roller 75, opposing to the secondary transferring roller 8A, has substantially the same structure as those of the primary transferring rollers 5YA, 5MA, 5CA, 5KA, and press-contacts the inner surface of the belt-type intermediate transfer member 7. The backup roller 75, being conductive, is constituted by a roller core body and an elastic layer, which is formed on the circumferential surface of the roller core body.

A single layer belt or a multi layer belt, made of polyamide, polyimide and the like and having a volume resistivity of $10^7$-$10^{12}$ Ωcm is employed for the belt-type intermediate transfer member 7.

When the belt-type intermediate transfer member 7 passes through the cleaning device 6A after the secondary transferring section 8 transfers the toner image onto the transfer material P, the cleaning device 6A cleans the surface of the belt-type intermediate transfer member 7.

Further, during the time other than the time of the secondary transferring operation, the secondary transferring roller 8A is separated from the circumferential surface of the belt-type intermediate transfer member 7 by a driving section (not shown in the drawings), so as to place it at a standby position.

<Pre-Secondary Transfer Charge Eliminating Section 9>

A pre-secondary transfer charge eliminating section 9, embodied in the present invention, is disposed at such a position where the belt-type intermediate transfer member 7 is supported in a state of a flat plane located between the primary transferring section 5K and the supporting roller 74 along the belt-type intermediate transfer member 7.

In the color image forming apparatus employing the intermediate transferring method, there has been a problem that a high quality image can be hardly obtained in the superimposed full color image due to a failure in the secondary transferring operation, even if the secondary transferring efficiency for a unicolor image is good. This is because, the full color image formed on the belt-type intermediate transfer member 7 is constituted by a wide variety of attached toner amount in a range of one toner layer to four toner layers as maximum, and accordingly, the optimization of the secondary transferring conditions is not necessarily uniform for such the wide variety of attached toner amount.

To overcome the abovementioned problem, an opposing electrode, made of a conductive brush, a conductive foaming material and the like face-contacts the belt-type intermediate transfer member 7 to electrically ground the belt-type intermediate transfer member 7, so as to achieve an improvement of the discharging efficiency higher than ever.

The pre-secondary transfer charge eliminating section 9, embodied in the present invention, is constituted by a first discharge device 9A1 and a second discharge device 9A2, both of which are disposed at the image bearing side of the belt-type intermediate transfer member 7, and, a first opposing electrode 9B1 and a second opposing electrode 9B2, both of which are disposed at the inner side of the belt-type intermediate transfer member 7.

<First Discharge Device 9A1 and Second Discharge Device 9A2>

Figure 3:
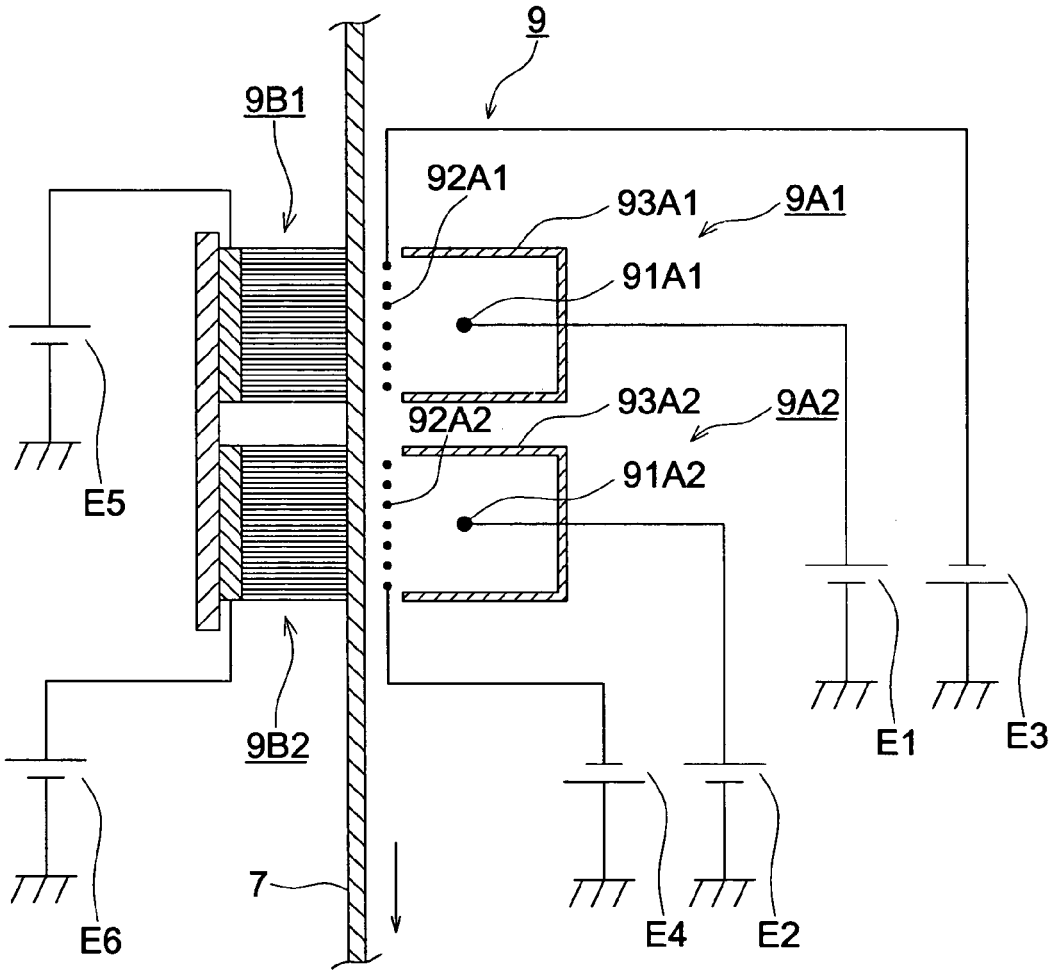
FIG. 3 shows a cross sectional view of a pre-secondary transfer charge eliminating section embodied in the present invention as a first embodiment.

FIG. 3 shows a cross sectional view of the pre-secondary transfer charge eliminating section 9, embodied in the present invention (first embodiment).

The first discharge device 9A1, disposed at an upstream side in the moving direction of the belt-type intermediate transfer member 7, is a scorotron charger including a discharging electrode 91A1 (a discharge wire), a grid electrode 92A1 and a side plate 93A1.

As shown in FIG. 3, the discharging electrode 91A1 is coupled to a DC power source E1. The grid electrode 92A1 is disposed at a position opposing to the circumferential surface of the belt-type intermediate transfer member 7 with a gap, and is coupled to a DC power source E3. The side plate 93A1 is coupled to a certain circuit (not shown in the drawings) so as to keep its electric potential the same as that of the grid electrode 92A1.

A wire rod material, made of tungsten stainless steel, gold and the like having a diameter in a range of 20-150 μm can be employed for the discharging electrode 91A1, and specifically, it is preferable that the surface of the wire rod material is coated with gold. It is applicable either to manufacture the wire rod material itself made of solid gold or to coat the surface of a metal core of the wire rod material, made of tungsten, stainless steel and the like with gold. In view of the removing efficiency of the discharge creating products, such as ozone gas and the like, the manufacturing cost and the discharging efficiency, it is preferable that the thickness of the coated gold layer is in a range of 1-5 μm as an average film thickness.

Any one of a wire-type grid made of wires, a plate-type grid on which a grid pattern is formed by applying an etching treatment, a plate-type grid on which a gold plating treatment is applied and the like can be employed for the grid electrode 92A1.

A voltage for activating a discharging action in a polarity opposite to that of the toner image is applied to the discharging electrode 91A1. A voltage having a polarity the same as that of the toner image is applied to the grid electrode 92A1.

The second discharge device 9A2, disposed at a downstream side in the moving direction of the belt-type intermediate transfer member 7, is a scorotron charger including discharging electrode 91A2, a grid electrode 92A2 and a side plate 93A2.

As shown in FIG. 3, the discharging electrode 91A2 is coupled to a DC power source E2. The grid electrode 92A2 is disposed at a position opposing to the circumferential surface of the belt-type intermediate transfer member 7 with a gap, and is coupled to a DC power source E4. The side plate 93A2 is coupled to a certain circuit (not shown in the drawings) so as to keep its electric potential the same as that of the grid electrode 92A2.

The structure of the discharging electrode 91A2 is the same as that of the discharging electrode 91A1. Further, the structure of the grid electrode 92A2 is the same as that of the grid electrode 92A1, as well. A voltage for activating a discharging action in a polarity opposite to that of the toner image is applied to the discharging electrode 91A2, while a voltage having a polarity the same as that of the toner image is applied to the grid electrode 92A2.

<First Opposing Electrode 9B1 and Second Opposing Electrode 9B2>

The first opposing electrode 9B1 and the second opposing electrode 9B2, each including a conductive brush, which is mechanically coupled to a press-contact release mechanism (not shown in the drawings) for press-contacting and releasing the conductive brush to/from the belt-type intermediate transfer member 7, are disposed at an inner side of the belt-type intermediate transfer member 7, so as to oppose to the pre-secondary transfer charge eliminating section 9. The conductive brush abrasively contacts the inner side of the belt-type intermediate transfer member 7, and is electrically coupled to the ground.

It is desirable that the conductive brush is made of a conductive resin material, such as an acrylic, a nylon, a polyester, and the like, and has specifications indicated as follow.

Diameter of each fiber: 0.11-0.778 tex (in the metric unit of the yarn count method proposed by ISO)

Brush density: 12000-77000 fibers/$cm^2$

Resistivity of original fiber: $10^{o}$-$10^5$ Ωcm

The first opposing electrode 9B1 is coupled to a DC power source E5, so that a DC voltage, having a polarity opposite to that of the toner, is applied to the first opposing electrode 9B1. While, the second opposing electrode 9B2 is coupled to a DC power source E6, so that a DC voltage, having a polarity opposite to that of the toner, is applied to the second opposing electrode 9B2. Incidentally, the DC power source E5 and the DC power source E6 could be combined with each other to form a common DC power source.

EXAMPLES

Concrete examples of the present invention will be detailed in the following. However, the scope of the present invention is not limited to the following examples.

<Image Forming Conditions>

Figure 4:
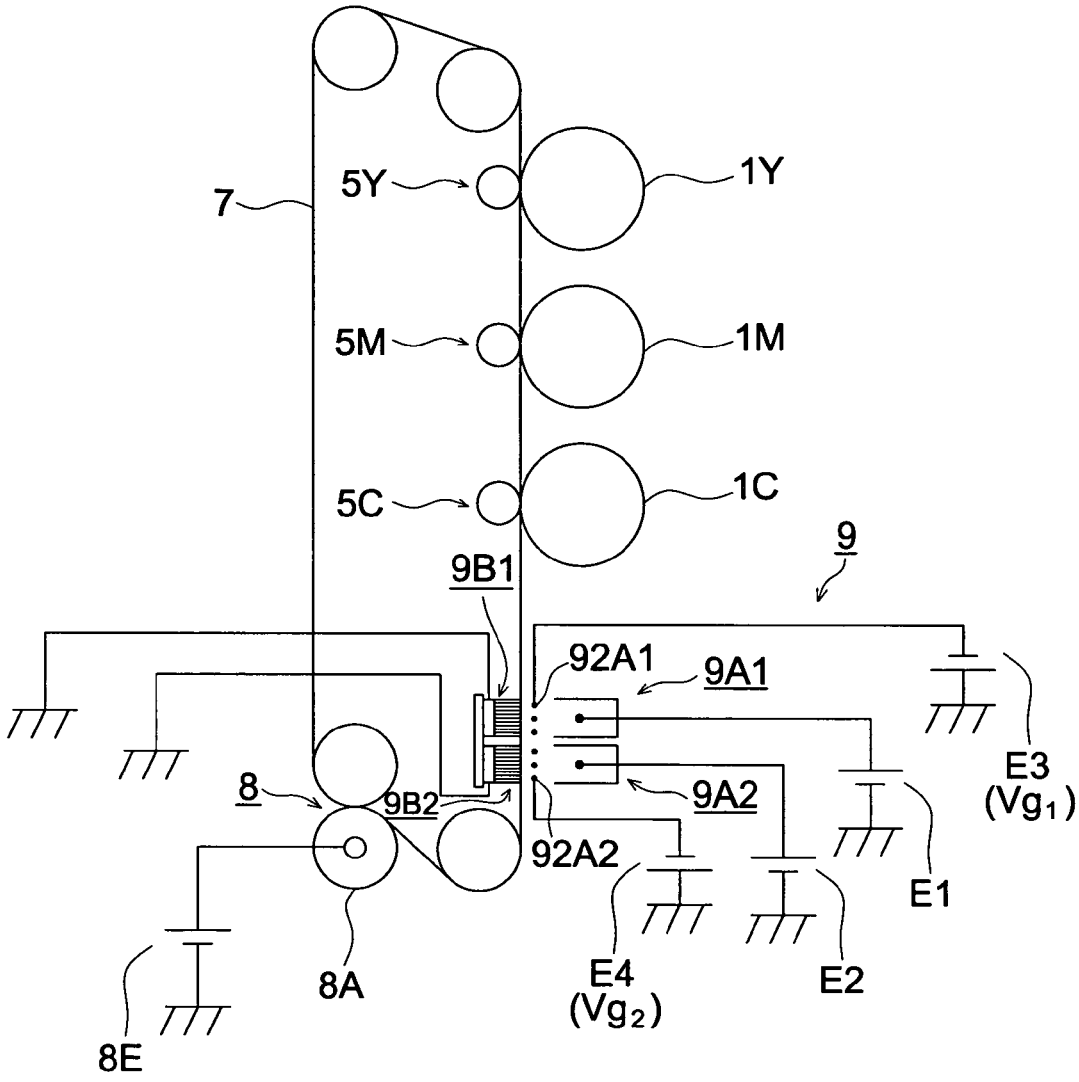
FIG. 4 shows a schematic diagram of a main part of a pre-secondary transfer charge eliminating section embodied in the present invention as a second embodiment.

IMAGE FORMING APPARATUS: TANDEM-TYPE FULL COLOR COPIER (MODIFIED VERSION OF KONICAMINOLTA 8050 (TRADE MARK)), having a continuous copy speed of 51 sheets/minute for A4 size sheet in the full color copy mode FIG. 4 shows a schematic diagram of the main part of the pre-secondary transfer charge eliminating section 9 (the second embodiment).

In order to confirm the effects of the present invention, the color image forming apparatus A, in which the primary transferring sections 5Y, 5M, 5C, 5K and the secondary transferring section 8, shown in FIG. 2, were equipped, while the image bearing member 1K, the charging section 2K, the developing section 4K and the cleaning section 6K disposed in the image forming section 10K, serving as a fourth image forming stage, were removed, and the pre-secondary transfer charge eliminating section 9 embodied in the present invention was equipped therein instead of the image forming section 10K, was employed for forming images as the present embodiment.

Image bearing members 1Y, 1M, 1C: outer diameter ϕ; 60 mm

Conveyance line velocity of the transfer material P: 220 mm/sec

Developer: average particle diameter of carrier; 20-60 μm, average particle diameter of polymerization toner; 3-7 μm Charging sections 2Y, 2M, 2C: charge voltage V0; −700 V (variable: indicated is a standard value)

Exposure sections 3Y, 3M, 3C: wavelength of semiconductor laser; 780 nm, surface potential of photoreceptor member at the time of exposure Vi; −50 V Developing sections 4Y, 4M, 4C: electric potential Vdc of developing sleeve; −500 V (variable: indicated is a standard value), developing bias alternate voltage component Vac; 1 kVp-p rectangular waveform (frequency: 5 kHz)

Primary transferring rollers 5YA, 5MA, 5CA: conductive roller is employed, roller pressure; 50 N (Newton), transferring current: 40 μA, applied transferring voltage; +1.5 kV Secondary transferring section 8: having a structure in which the backup roller 75 presses the secondary transferring roller 8A while putting the belt-type intermediate transfer member 7 between them, resistivity of both of them; $1\times10^7$Ω, applying a predetermined current value selected from Table of current values in a matrix of temperature/humidity and counter Pressing pressure: 50 N (Newton)

Nip width in a conveying direction of transfer material: 3 mm

Elastic layer of secondary transferring roller 8A: semi-conductive NBR solid rubber (acrylonitrile-butadiene rubber), volume resistivity; $4\times10^7$Ω, outer diameter ϕ; 40 mm Belt-type intermediate transfer member 7: polyimide resin, seamless semi-conductive belt (volume resistivity; $4\times10^9$ Ωcm), threading tension; 50 N, line velocity; 220 mm/sec

[Pre-Secondary Transfer Charge Eliminating Section 9]

<First Discharge Device 9A1 and Second Discharge Device 9A2>

The first discharge device 9A1 and the second discharge device 9A2, each having the same shape as that of the scorotron charger which is normally employed for the image bearing member, are disposed in parallel in the apparatus concerned.

The discharging electrode 91A1 and the discharging electrode 91A2 are coupled to the DC power source E1 of high voltage and the DC power source E2 of high voltage, respectively, so as to apply electric currents in a range of 0-400 μA to the discharging electrode 91A1 and the discharging electrode 91A2. The grid electrode 92A1 and the grid electrode 92A2 are coupled to the DC power source E3 of high voltage and the DC power source E4 of high voltage, respectively, so as to apply electric voltages in a range of 0-−300 V to the grid electrode 92A1 and the grid electrode 92A2.

The first discharge device 9A1 and the second discharge device 9A2 are so constituted that DC bias voltages for activating a discharging action in a polarity opposite to that of the toner image can be applied to the discharging electrode 91A1 and the discharging electrode 91A2, and DC voltages can be applied to the grid electrode 92A1 and the grid electrode 92A2, respectively. An open area ratio of each of the grid electrode 92A1 and the grid electrode 92A2 is 90%.

In the present embodiment, the first discharge device 9A1 and the second discharge device 9A2 are so constituted that DC voltages for activating a discharging action in a polarity opposite to that of the toner image can be applied to the discharging electrode 91A1 and the discharging electrode 91A2, and DC voltages can be applied to the grid electrode 92A1 and the grid electrode 92A2, respectively.

In this example, corresponding to the toner image having a negative charge, DC voltages having a positive polarity are applied to the discharging electrode 91A1 and the discharging electrode 91A2 of the pre-secondary transfer charge eliminating section 9, while DC voltages having a negative polarity are applied to the grid electrode 92A1 and the grid electrode 92A2, respectively.

In this example, the electric potentials of the side plate 93A1 and the side plate 93A2 are set at the same potentials of the grid electrode 92A1 and the grid electrode 92A2, respectively. The grid electrode 92A1 and the grid electrode 92A2 are disposed in such a manner that the grid electrode 92A1 and the grid electrode 92A2 are parallel to the belt-type intermediate transfer member 7 with a gap of 1 mm.

The width of the discharging electrode 91A1 (the length in the moving direction of the belt-type intermediate transfer member 7) is set at 30 mm, while the length in a longitudinal direction of the discharging electrodes 91A1 (the length in the direction orthogonal to the moving direction of the belt-type intermediate transfer member 7) is set at 320 mm.

The first opposing electrode 9B1 and the second opposing electrode 9B2, each including a conductive brush, which is mechanically coupled to a press-contact release mechanism (not shown in the drawings) for press-contacting and releasing the conductive brush to/from the belt-type intermediate transfer member 7, are disposed at the inner side of the belt-type intermediate transfer member 7, so as to oppose to the first discharge device 9A1 and the second discharge device 9A2, respectively.

The conductive brush employed in this example has the specification indicated as follow.

Resistivity of original fiber: $10^2$ Ωcm

Diameter of each fiber: 3 denier (a degree of fineness at a length of 4560 m and a mass of 50 mg is defined as 1 denier)

Density: 200 kF/inch$^2$ (F is a number of filaments, 1 inch is 25.4 mm)

Fiber length: 3 mm

The width of the conductive brush formed on each of the first opposing electrode 9B1 and the second opposing electrode 9B2 (namely, its length in the moving direction of the belt-type intermediate transfer member 7) is set at 30 mm, while the length of the conductive brush in its longitudinal direction (namely, its length in the direction orthogonal to the moving direction of the belt-type intermediate transfer member 7) is set at 320 mm.

An absolute value of the difference between an electric potential Vg1 of the grid electrode 92A1 of the first discharge device 9A1, disposed upstream in the moving direction of the belt-type intermediate transfer member 7, and an electric potential Vb1 of the first opposing electrode 9B1, and another absolute value of the difference between an electric potential Vg2 of the grid electrode 92A2 of the second discharge device 9A2, disposed downstream in the moving direction of the belt-type intermediate transfer member 7, and an electric potential Vb2 of the second opposing electrode 9B2, are established so as to fulfill the following relationship.

$$|Vg1-Vb1|>|Vg2-Vb2|$$

When the conductive brushes of the first opposing electrode 9B1 and the second opposing electrode 9B2 are coupled to the ground while abrasively contacting the inner surface of the belt-type intermediate transfer member 7, respectively, the electric potential Vb1 and the electric potential Vb2 are zero volt. Accordingly, the above relationship becomes $$|Vg1|>|Vg2|.$$

In order to confirm the effects of the present invention, the electric potentials of the toner layers are measured before and after the discharging operations, with respect to the example 1 in which the discharging ability of the first discharge device 9A1 disposed upstream in the moving direction of the belt-type intermediate transfer member 7 is lowered, compared to that of the second discharge device 9A2 disposed downstream in the moving direction of the belt-type intermediate transfer member 7, the comparison examples 1, 2, 3 in each of which the discharging abilities of the first discharge device 9A1 and the second discharge device 9A2, respectively disposed upstream and downstream in the moving direction of the belt-type intermediate transfer member 7, are equivalent relative to each other, and the comparison example 4 in which the discharging ability of the first discharge device 9A1 disposed upstream in the moving direction of the belt-type intermediate transfer member 7 is heightened, compared to that of the second discharge device 9A2 disposed downstream in the moving direction of the belt-type intermediate transfer member 7. The results of the measurements are indicated in Table 1.

TABLE 1

| | Grid potential | | Discharge wire current | |
|---|---|---|---|---|
| | Vg1 at upstream side | Vg2 at downstream side | $I_1$ at upstream side | $I_2$ at downstream side |
| Example 1 | −150 V | −50 V | 350 μA | 200 μA |
| Comparison Example 1 | −150 V | −150 V | 350 μA | 350 μA |
| Comparison Example 2 | −50 V | −50 V | 200 μA | 200 μA |
| Comparison Example 3 | −100 V | −100 V | 300 μA | 300 μA |
| Comparison Example 4 | −50 V | −150 | 200 μA | 350 μA |

As shown in Table 1, in Example 1, the absolute value of the electric potential Vg1 of the grid electrode 92A1 disposed at the upstream side is set to such a value that is greater than that of the electric potential Vg2 of the grid electrode 92A2 disposed at the downstream side. Concretely speaking, a negative voltage, having the polarity the same as that of the charge of the toner image, is applied to both the grid electrode 92A1 disposed at the upstream side and the grid electrode 92A2 disposed at the downstream side, so that the high grid voltage of −150 V is applied to the toner image in the first stage discharging operation, and then, the low grid voltage of −50 V is applied to the same toner image in the second stage discharging operation. According to the above, it becomes possible to suppress the potential drop at the portions carrying the small amount of toner within a narrow range, resulting in an achievement of the good transferability in the secondary transferring operation.

Further, as shown in Table 1, in Example 1, the discharge wire current $I_1$ of the discharging electrode 91A1 disposed at the upstream side is set to such a value that is greater than the discharge wire current $I_2$ of the discharging electrode 91A2. Concretely speaking, the discharge wire current $I_1$ of the discharging electrode 91A1 disposed at the upstream side is set at 350 μA, while the discharge wire current $I_2$ of the discharging electrode 91A2 disposed at the downstream side is set at 200 μA. According to the above, it becomes possible to suppress the potential drop at the portions carrying the small amount of toner within a narrow range, resulting in an achievement of the good transferability in the secondary transferring operation.

Incidentally, values of the electric potential Vg1 of the grid electrode 92A1, the electric potential Vg2 of the grid electrode 92A2, the discharge wire current $I_1$ of the discharging electrode 91A1 and the discharge wire current $I_2$ of the discharging electrode 91A2, are not limited to the values indicated in Example 1 of Table 1.

Figure 5:
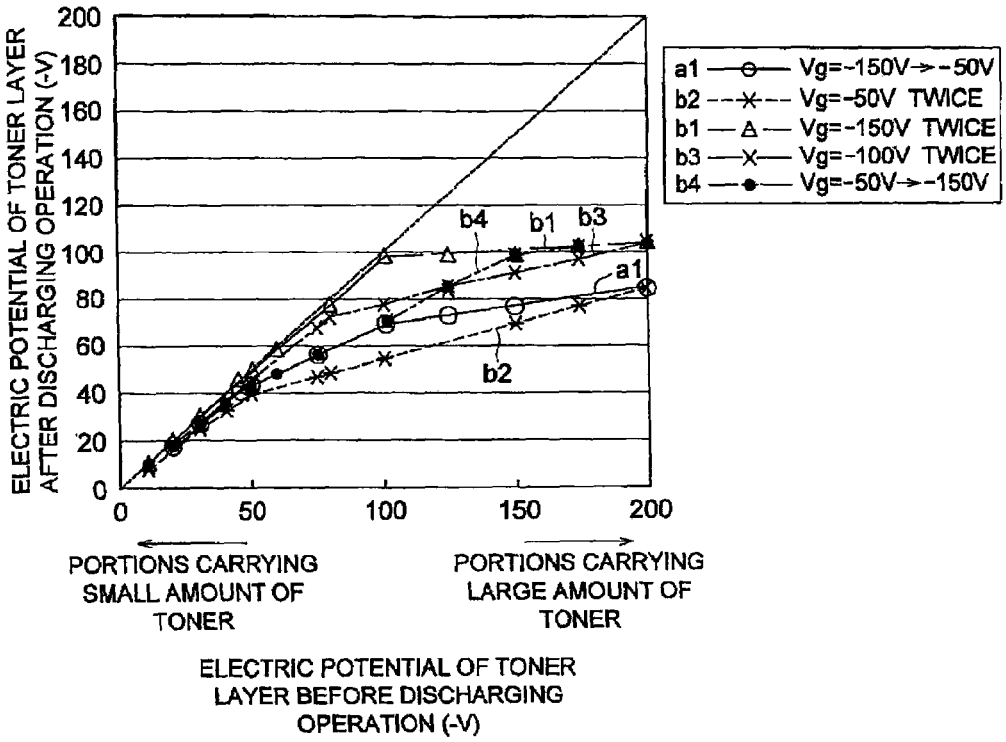
FIG. 5 shows a characteristic graph of electric potentials of a toner layer, which are measured after pre-secondary transfer charge eliminating operations are conducted twice by a first discharge device and a second discharge device.

FIG. 5 shows a characteristic graph of the electric potentials of the toner layer, which are measured after the pre-secondary transfer charge eliminating operations are conducted twice by the first discharge device 9A1 and the second discharge device 9A2.

Line segments a1 represent the electric potentials of the toner layer before and after the discharging operation with two grid potentials Vg1 and Vg2.

Line segments b1 represent the electric potentials of the toner layer in Comparison Example 1. In Comparison Example 1, the electric potential Vg1 of the grid electrode 92A1 provided in the first discharge device 9A1 disposed at the upstream side is set at −150 V, and the electric potential Vg2 of the grid electrode 92A2 provided in the first discharge device 9A2 disposed at the downstream side is set at −150 V as well, (namely, |Vg1|=|Vg2|).

Line segments b2 represent the electric potentials of the toner layer in Comparison Example 2. In Comparison Example 2, the electric potential Vg1 of the grid electrode 92A1 provided in the first discharge device 9A1 is set at −50 V, and the electric potential Vg2 of the grid electrode 92A2 provided in the first discharge device 9A2 is set at −50 V as well, (namely, |Vg1|=|Vg2|).

Line segments b3 represent the electric potentials of the toner layer in Comparison Example 3. In Comparison Example 3, the electric potential Vg1 of the grid electrode provided in the first discharge device 9A1 is set at −100 V, and the electric potential Vg2 of the grid electrode provided in the first discharge device 9A2 is set at −100 V as well, (namely, |Vg1|=|Vg2|).

Line segments b4 represent the electric potentials of the toner layer in Comparison Example 4. In Comparison Example 4, the electric potential Vg1 of the grid electrode provided in the first discharge device 9A1 is set at −50 V, while the electric potential Vg2 of the grid electrode 92A2 provided in the first discharge device 9A2 is set at −150 V, (namely, |Vg1|>|Vg2|).

With respect to the electric potentials of the toner layer in Example 1, it becomes possible to obtain a good controllability for stably keeping the electric potentials for the portions carrying large amounts of toner within a range of −70--80 V while suppressing the electric potential drop at the portions carrying small amounts of toner, resulting in an achievement of a good image forming operation.

In Comparison Examples 1, 3, 4, it is impossible to obtain a sufficient efficiency for dropping the potential values of portions carrying the large amount of toner, such as a superimposed solid color image area, to a desired value, resulting in transferring defects in the portions carrying the large amount of toner. According to the line segments b2 in Comparison Example 2, since the electric potential at an area in the vicinity of the portions carrying the small amount of toner, such as a halftone image area, is lowered, image roughness would occur in the portions carrying the small amount of toner.

FIGS. 6-11 show schematic block diagrams indicating other modifications of the pre-secondary transfer charge eliminating section 9, embodied in the present invention. In FIGS. 6-11, the reference numbers the same as those shown in FIG. 4 are attached to the blocks having the function the same as those shown in FIG. 4. Further, only the points being different from those shown in FIG. 4 will be detailed in the following.

The effects similar to those of Example 1 can be attained by employing the pre-secondary transfer charge eliminating section 9 shown in any one of FIGS. 6-11, provided that the following relationship is fulfilled.

$$|Vg1-Vb1|>|Vg2-Vb2|$$

Figure 6:
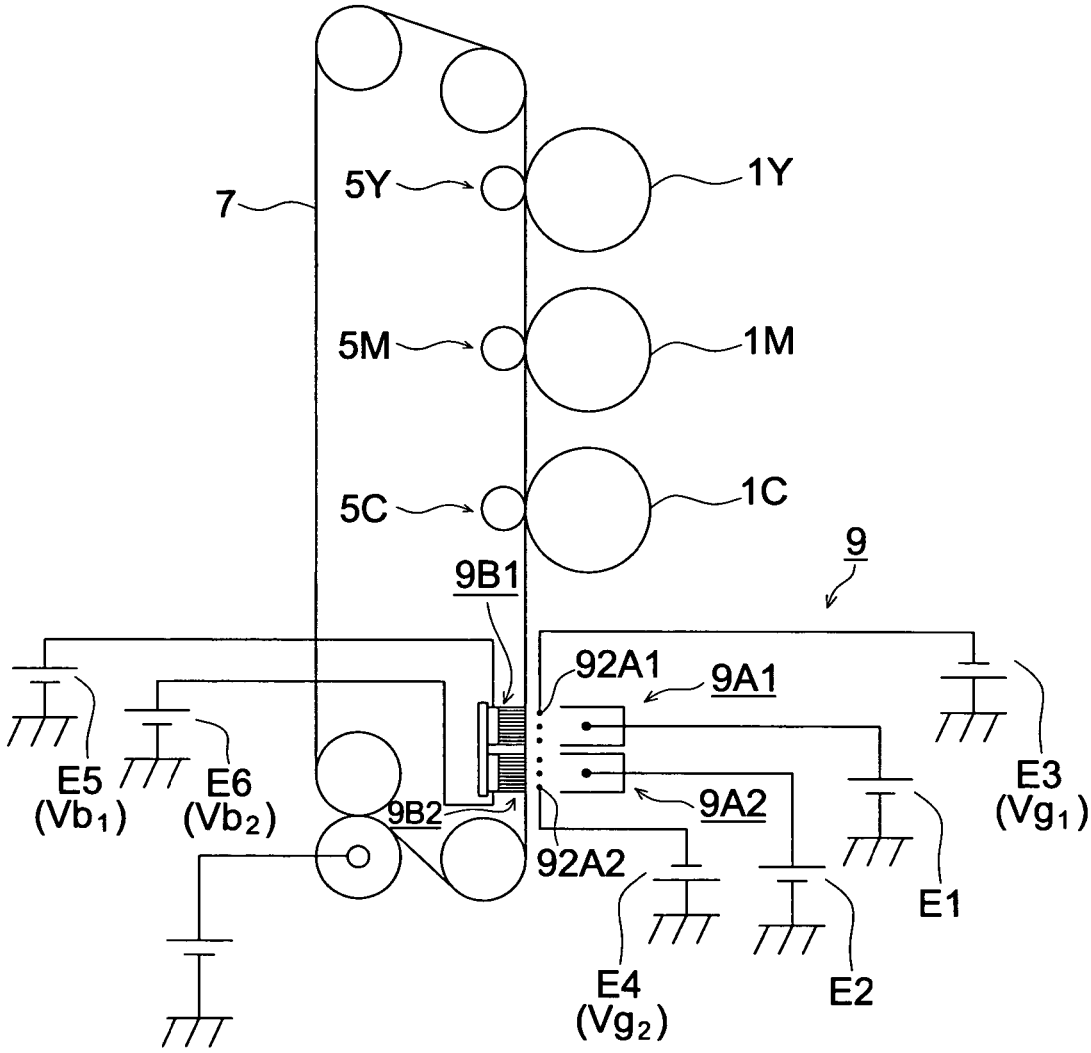
FIG. 6 shows a schematic block diagram indicating another example of a pre-secondary transfer charge eliminating section, embodied in the present invention.

In the pre-secondary transfer charge eliminating section 9 shown in FIG. 6, the DC power source E5 is coupled to the first opposing electrode 9B1, so as to apply the electric potential Vb1 to the first opposing electrode 9B1, and the DC power source E6 is coupled to the second opposing electrode 9B2, so as to apply the electric potential Vb2 to the second opposing electrode 9B2.

Figure 7:
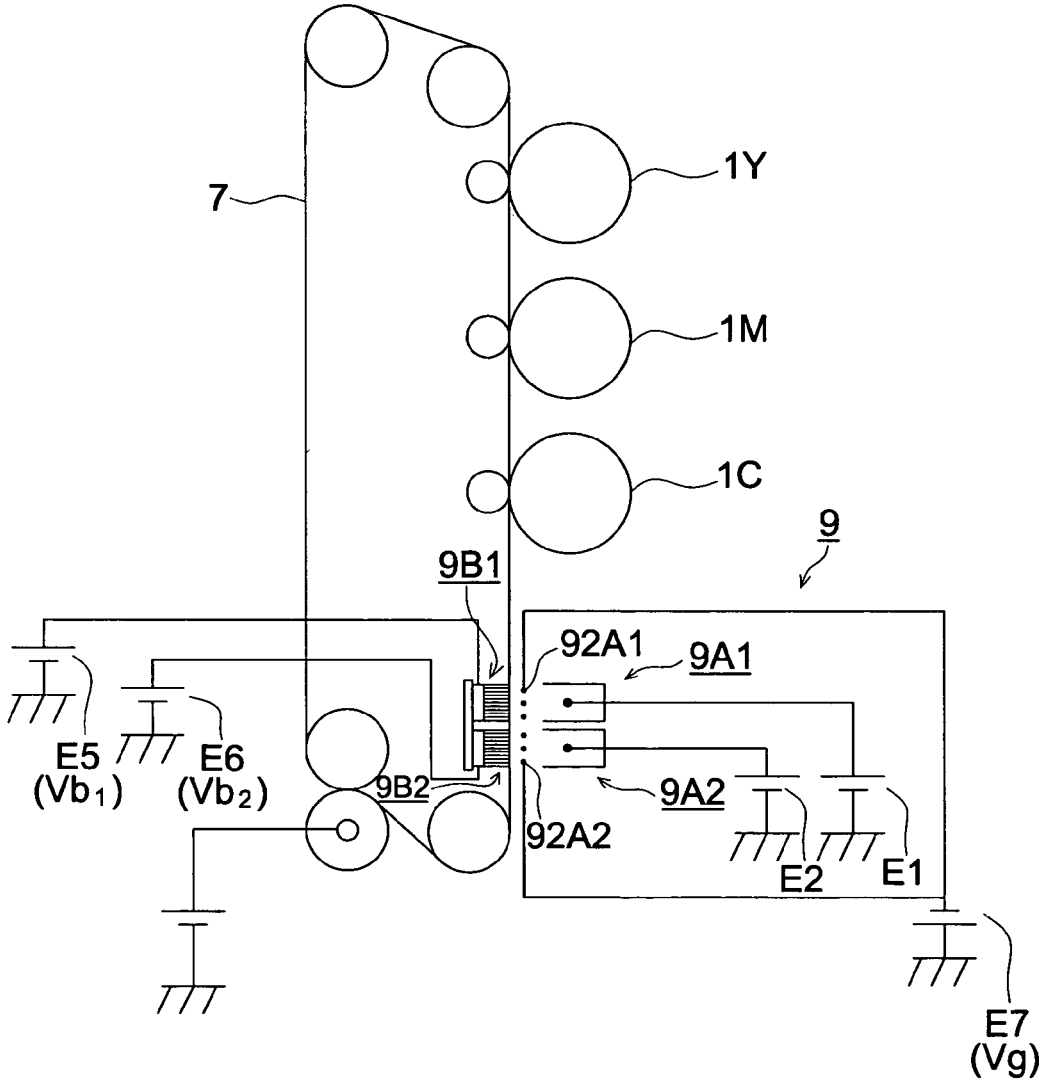
FIG. 7 shows a schematic block diagram indicating another example of a pre-secondary transfer charge eliminating section, embodied in the present invention.

In the pre-secondary transfer charge eliminating section 9 shown in FIG. 7, both the first grid electrode 92A1 of the first discharge device 9A1 and the second grid electrode 92A2 of the second discharge device 9A2 are coupled to a common DC power source E7, so as to apply the electric potential Vg to both of them.

Figure 8:
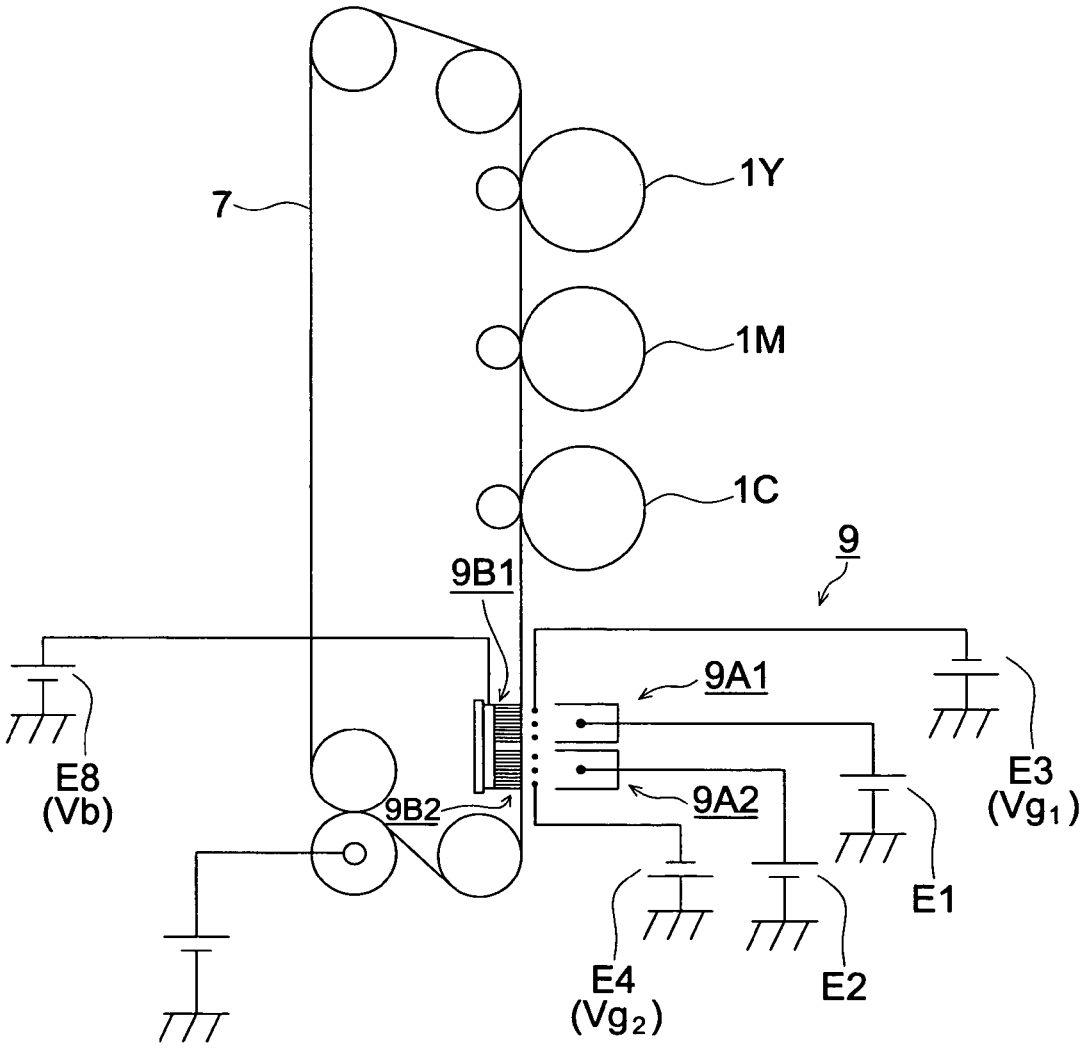
FIG. 8 shows a schematic block diagram indicating another example of a pre-secondary transfer charge eliminating section, embodied in the present invention.

In the pre-secondary transfer charge eliminating section 9 shown in FIG. 8, both the first opposing electrode 9B1 and the second opposing electrode 9B2 are coupled to a common DC power source E8, so as to apply the electric potential Vb to both of them.

Figure 9:
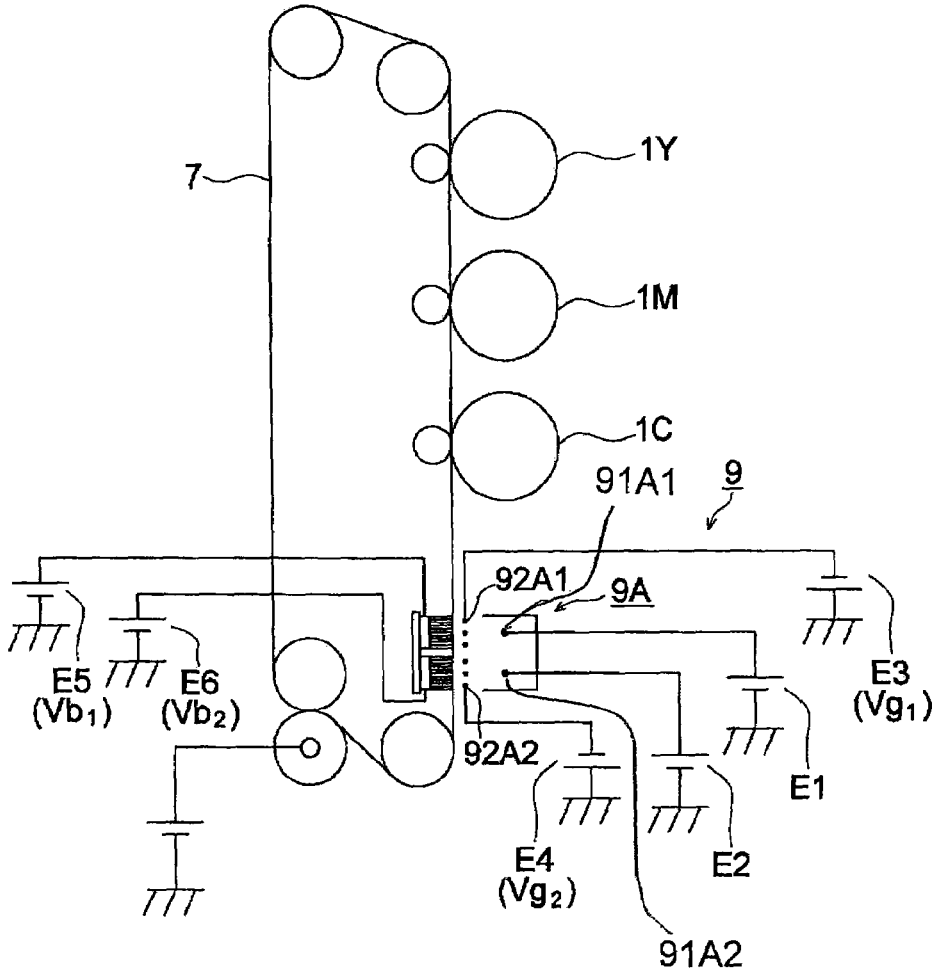
FIG. 9 shows a schematic block diagram indicating another example of a pre-secondary transfer charge eliminating section, embodied in the present invention.

In the pre-secondary transfer charge eliminating section 9 shown in FIG. 9, two discharging electrodes 91A1, 91A2 are mounted in a single discharge device 9A, and the discharging electrodes 91A1, 91A2 are coupled to the DC power source E1 and the DC power source E2, respectively.

Figure 10:
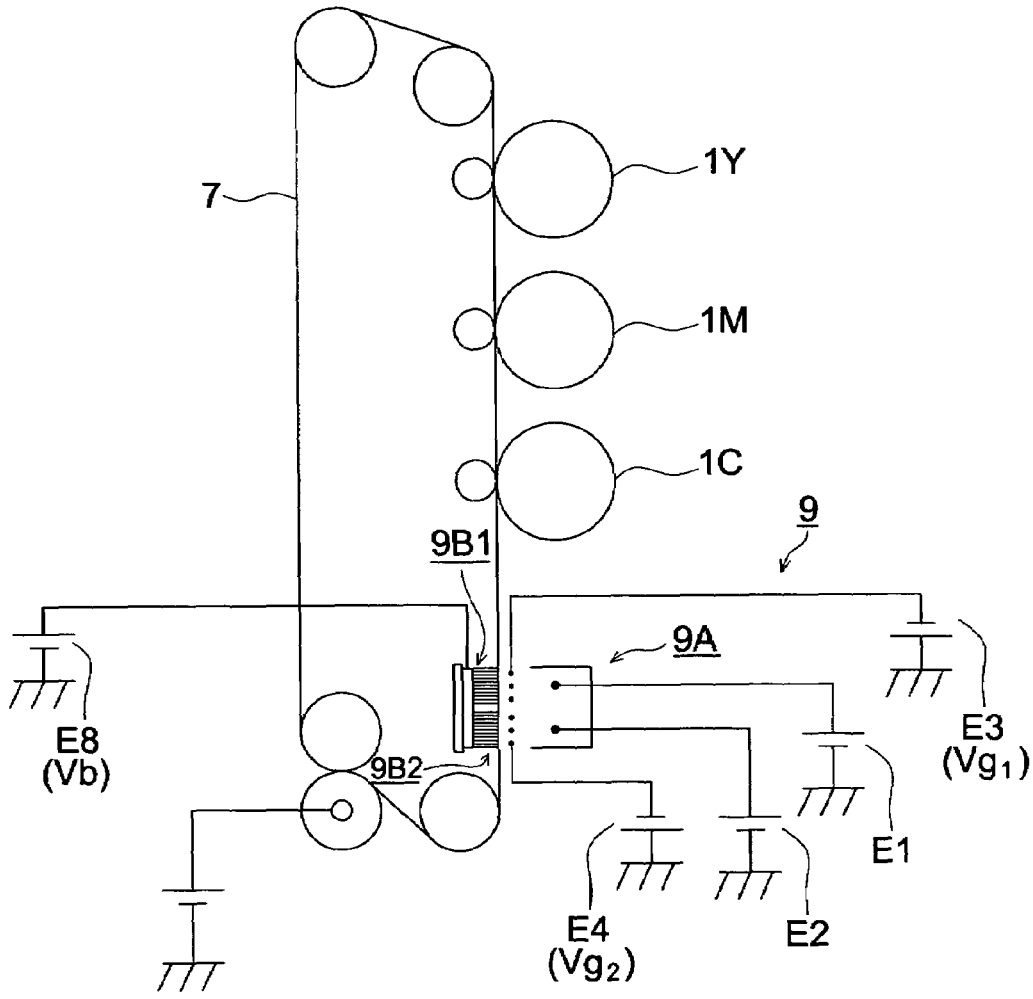
FIG. 10 shows a schematic block diagram indicating another example of a pre-secondary transfer charge eliminating section, embodied in the present invention.

In the pre-secondary transfer charge eliminating section 9 shown in FIG. 10, both the first opposing electrode 9B1 and the second opposing electrode 9B2 are coupled to the common DC power source E8 being similar to that shown in FIG. 8, so as to apply the electric potential Vb to both of them.

Figure 11:
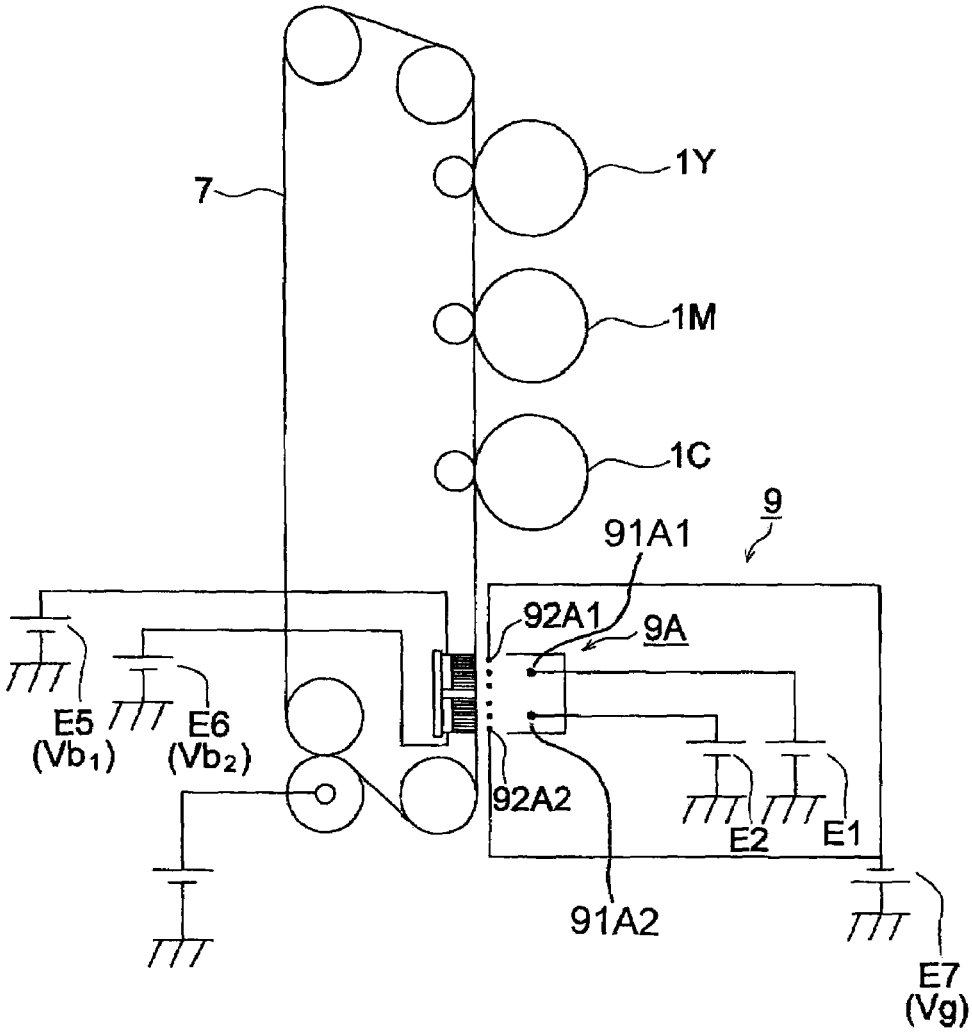
FIG. 11 shows a schematic block diagram indicating another example of a pre-secondary transfer charge eliminating section, embodied in the present invention.

In the pre-secondary transfer charge eliminating section 9 shown in FIG. 11, two discharging electrodes 91A1, 91A2 are mounted in a single discharge device 9A, and the discharging electrodes 91A1, 91A2 are coupled to the DC power source E1 and the DC power source E2, respectively. Further, the grid electrode 92A1 of the first discharge device 9A1 and the grid electrode 92A2 of the second discharge device 9A2 are coupled to the common DC power source E7, so as to apply the electric potential Vg to both of them.

Example 2

Figure 12:
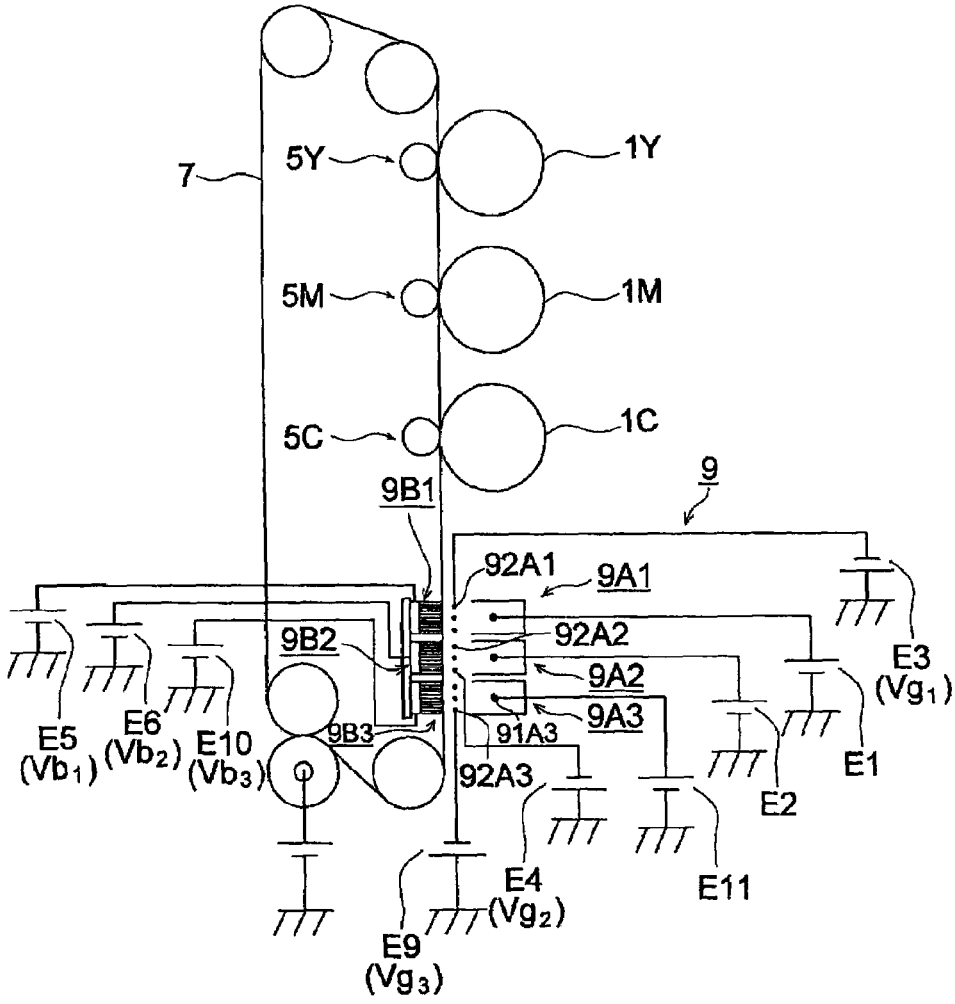
FIG. 12 shows a schematic diagram indicating a main part of a pre-secondary transfer charge eliminating section employed in Example 2 embodied in the present invention.

FIG. 12 shows a schematic diagram indicating a main part of the pre-secondary transfer charge eliminating section 9 employed in Example 2 embodied in the present invention. Incidentally, the reference numbers the same as those shown in FIG. 6 are attached to the blocks having the functions the same as those shown in FIG. 6. Accordingly, only the points different from those shown in FIG. 6 will be detailed in the following.

As shown in FIG. 12, in the pre-secondary transfer charge eliminating section 9 of Example 2, a pair of the first discharge device 9A1 and the first opposing electrode 9B1, a pair of the second discharge device 9A2 and the second opposing electrode 9B2, and a pair of a third discharge device 9A3 and a third opposing electrode 9B3 are arranged in order from the upstream side in the moving direction of the belt-type intermediate transfer member 7.

Further, a discharging electrode 91A3 of the third discharge device 9A3 is coupled to a DC power source E11 of high voltage, so as to apply electric currents in a range of 0-400 μA to the discharging electrode 91A3.

The grid electrode 92A1 of the first discharge device 9A1 is coupled to the DC power source E3 to apply the electric potential Vg1 to the grid electrode 92A1, the grid electrode 92A2 of the second discharge device 9A2 is coupled to the DC power source E4 to apply the electric potential Vg2 to the grid electrode 92A2, and the grid electrode 92A3 of the third discharge device 9A3 is coupled to a DC power source E9 to apply an electric potential Vg3 to the grid electrode 92A3.

The first opposing electrode 9B1 is coupled to the DC power source E5 to apply the electric potential Vb1 to the first opposing electrode 9B1, the second opposing electrode 9B2 is coupled to the DC power source E6 to apply the electric potential Vb2 to the second opposing electrode 9B2, and the third opposing electrode 9B3 is coupled to a DC power source E10 to apply an electric potential Vb3 to the third opposing electrode 9B3.

In Example 2, the absolute value |Vg1−Vb1| of the potential difference between the electric potential of the first discharge device 9A1 located at a most upstream position and that of the first opposing electrode 9B1, the absolute value |Vg2−Vb2| of the potential difference between the electric potential of the second discharge device 9A2 located at a middle position and that of the second opposing electrode 9B2, and the absolute value |Vg3−Vb3| of the potential difference between the electric potential of the third discharge device 9A3 located at a most downstream position and that of the third opposing electrode 9B3, are established at such values that fulfill the following relationship.

$$|Vg1-Vb1| \geqq |Vg2-Vb2| \geqq |Vg3-Vb3|$$

By respectively setting the discharging electric potentials for three pairs of the discharge devices 9A1, 9A2, 9A3 and the opposing electrodes 9B1, 9B2, 9B3, at the values as mentioned above, it becomes possible to suppress the potential drop at the portions carrying the small amount of toner within a narrow range, and accordingly, it also becomes possible to attain a stable and good controllability of the electric potential in a region from the portions carrying the middle amount of toner to the portions carrying the large amount of toner, resulting in an achievement of the high quality image-forming operation.

In the embodiments described in the foregoing, the output potentials of the discharging electrodes 91A1, 91A2 are changed as the method for changing the discharging outputs to both upstream and downstream sides of the belt-type intermediate transfer member 7, namely, an amount of ions arriving to the belt-type intermediate transfer member 7. However, other than the above, a certain appropriate method could be employed for obtaining the same effect.

Concretely speaking, the method for changing the output electric potential corresponding to the open area ratios of the grid electrodes 92A1, 92A2 could be employed for this purpose. For instance, the open area ratio at the upstream side is set at 90%, while the open area ratio at the downstream side is set at 80%, which is smaller than that at the upstream side.

Alternatively, the distance between the discharging electrode 91A1 disposed at the upstream side and the belt-type intermediate transfer member 7 is set at 7 mm, while the distance between the discharging electrode 91A2 disposed at the downstream side and the belt-type intermediate transfer member 7 is set at 8.5 mm, which is greater than that at the upstream side.

By setting the grid electrode 92A1, grid electrode 92A2, the discharging electrode 91A1 and the discharging electrode 91A2 as mentioned above, it becomes possible to suppress the potential drop at the portions carrying the small amount of toner within a narrow range. Accordingly, it becomes possible not only to prevent the image roughness occurring at the portions carrying the small amount of toner, but also to obtain a good secondary transferring efficiency even for the superimposed toner image.

Further, although the examples described in the foregoing employs the belt-type intermediate transfer member as an intermediate transfer member, it is needless to say that the present invention can be applied to another type intermediate transfer member, such as an intermediate transfer drum, or the like.

While the preferred embodiments of the present invention have been described using specific term, such description is for illustrative purpose only, and it is to be understood that changes and variations may be made without departing from the spirit and scope of the appended claims.

What is claimed is:

1. A color image forming apparatus for forming a color image onto a transfer material by superimposing a plurality of unicolor toner images, comprising:

a plurality of image bearing members to form the plurality of unicolor toner images on the plurality of image bearing members, respectively;

a plurality of primary transferring sections that correspond to the plurality of image bearing members to transfer the plurality of unicolor toner images formed on the plurality of image bearing members, respectively;

an intermediate transfer member onto which the plurality of unicolor toner images are successively transferred one by one in such a manner that the plurality of unicolor toner images are superimposed on each other, so as to form a full color toner image on a toner-image bearing surface of the intermediate transfer member;

a secondary transferring section to transfer the full color toner image, formed on the toner-image bearing surface of the intermediate transfer member, onto the transfer material; and a pre-secondary transfer charge eliminating section disposed between the plurality of primary transferring sections and the secondary transferring section, including a plurality of discharge devices aligned along the toner-image bearing surface of the intermediate transfer member and an opposing electrode aligned along another surface of the intermediate transfer member opposing to the plurality of discharge devices;

wherein each of the plurality of discharge devices includes a discharging electrode and a grid electrode; and wherein an electric potential difference between the grid electrode disposed at an upstream side in a rotating direction of the intermediate transfer member and the opposing electrode, is greater than that between the grid electrode disposed at a downstream side in a rotating direction of the intermediate transfer member and the opposing electrode.

2. The color image forming apparatus of claim 1, wherein an absolute value of an electric potential of the discharging electrode disposed at the upstream side is greater than that of the discharging electrode disposed at the downstream side.

3. The color image forming apparatus of claim 1, wherein an open area ratio of the grid electrode disposed at the upstream side is greater than that of the grid electrode disposed at the downstream side.

4. The color image forming apparatus of claim 1, wherein a distance between the discharging electrode and the grid electrode, both disposed at the upstream side, is smaller than that between the discharging electrode and the grid electrode, both disposed at the downstream side.

5. The color image forming apparatus of claim 1, wherein voltages, having a polarity opposite to that of the full color toner image formed on the intermediate transfer member, are applied to the discharging electrodes disposed at the upstream side and the downstream side.

6. The color image forming apparatus of claim 1, wherein voltages, having a polarity the same as that of the full color toner image formed on the intermediate transfer member, are applied to the grid electrodes disposed at the upstream side and the downstream side.

7. The color image forming apparatus of claim 1, wherein the opposing electrode has a first opposing electrode opposing to the discharge device disposed at the upstream side and a second opposing electrode opposing to the discharge device disposed at the downstream side.

8. The color image forming apparatus of claim 7, both the first opposing electrode and the second opposing electrode are coupled to a common power source.

9. The color image forming apparatus of claim 7, each of the first opposing electrode and the second opposing electrode are coupled to corresponding power sources.

10. The color image forming apparatus of claim 7, both the first opposing electrode and the second opposing electrode are coupled to ground.

* * * * *

UNITED STATES PATENT AND TRADEMARK OFFICE

CERTIFICATE OF CORRECTION

PATENT NO. : 7,639,974 B2
APPLICATION NO. : 11/602563
DATED : December 29, 2009
INVENTOR(S) : Kimura et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 518 days.

Signed and Sealed this

Ninth Day of November, 2010

David J. Kappos

David J. Kappos
*Director of the United States Patent and Trademark Office*